US009163477B2

(12) United States Patent
Frazier

(10) Patent No.: US 9,163,477 B2
(45) **Date of Patent: *Oct. 20, 2015**

(54) CONFIGURABLE DOWNHOLE TOOLS AND METHODS FOR USING SAME

(76) Inventor: W. Lynn Frazier, Corpus Christi, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/488,890

(22) Filed: Jun. 5, 2012

(65) Prior Publication Data

US 2012/0279700 A1 Nov. 8, 2012

Related U.S. Application Data

(63) Continuation-in-part of application No. 13/194,820, filed on Jul. 29, 2011, which is a continuation-in-part of application No. 12/799,231, filed on Apr. 21, 2010, now abandoned.

(60) Provisional application No. 61/214,347, filed on Apr. 21, 2009.

(51) Int. Cl.

| | |
|---|---|
| ***E21B 33/129*** | (2006.01) |
| ***E21B 33/134*** | (2006.01) |
| ***E21B 34/06*** | (2006.01) |
| ***E21B 34/14*** | (2006.01) |

(52) U.S. Cl.

CPC ..... *E21B 33/129* (2013.01); *E21B 33/134* (2013.01); *E21B 34/063* (2013.01); *E21B 34/14* (2013.01)

(58) Field of Classification Search

CPC ... E21B 23/06; E21B 33/1204; E21B 33/129; E21B 33/134

USPC ..... 166/118, 123, 124, 133, 135

See application file for complete search history.

(56) References Cited

U.S. PATENT DOCUMENTS

| | | | |
|---|---|---|---|
| 1,476,727 | A | 12/1923 | Quigg |
| RE17,217 | E | 2/1929 | Burch |

(Continued)

FOREIGN PATENT DOCUMENTS

| | | |
|---|---|---|
| GB | 914030 | 12/1962 |
| WO | WO02083661 | 10/2002 |

(Continued)

OTHER PUBLICATIONS

"Teledyne Merla Oil Tools—Products Services," Teledyne Merla, Aug. 1990 (40 pages).

(Continued)

*Primary Examiner* — Robert E Fuller

(74) *Attorney, Agent, or Firm* — Edmonds & Nolte, P.C.

(57) ABSTRACT

An insert for a downhole plug for use in a wellbore. The insert can include a body having a bore formed at least partially therethrough. One or more threads can be disposed on an outer surface of the body and adapted to threadably engage an inner surface of the plug proximate a first end of the plug. One or more shearable threads can be disposed on an inner surface of the body. The one or more shearable threads can be adapted to threadably engage a setting tool that enters the plug through the first end thereof and to deform to release the setting tool when exposed to a predetermined force that is less than a force required to deform the one or more threads disposed on the outer surface of the body. At least one impediment can be disposed within the body.

16 Claims, 8 Drawing Sheets

(56) References Cited

U.S. PATENT DOCUMENTS

| | | | | |
|---|---|---|---|---|
| 2,040,889 | A | | 5/1936 | Whinnen |
| 2,160,228 | A | | 5/1939 | Pustmueller |
| 2,223,602 | A | | 12/1940 | Cox |
| 2,230,447 | A | | 2/1941 | Bassinger |
| 2,286,126 | A | | 6/1942 | Thornhill |
| 2,331,532 | A | | 10/1943 | Bassinger |
| 2,376,605 | A | | 5/1945 | Lawrence |
| 2,555,627 | A | | 6/1951 | Baker |
| 2,589,506 | A | | 3/1952 | Morrisett |
| 2,593,520 | A | | 4/1952 | Baker et al. |
| 2,616,502 | A | | 11/1952 | Lenz |
| 2,630,865 | A | | 3/1953 | Baker |
| 2,637,402 | A | | 5/1953 | Baker et al. |
| 2,640,546 | A | | 6/1953 | Baker |
| 2,671,512 | A | | 3/1954 | Ragan et al. |
| 2,695,068 | A | | 11/1954 | Baker et al. |
| 2,713,910 | A | | 7/1955 | Baker et al. |
| 2,714,932 | A | | 8/1955 | Thompson |
| 2,737,242 | A | | 3/1956 | Baker |
| 2,756,827 | A | | 7/1956 | Farrar |
| 2,815,816 | A | * | 12/1957 | Baker ..... 166/63 |
| 2,830,666 | A | | 4/1958 | Rhodes |
| 2,833,354 | A | | 5/1958 | Sailers |
| 3,013,612 | A | | 12/1961 | Angel |
| 3,054,453 | A | | 9/1962 | Bonner |
| 3,062,296 | A | | 11/1962 | Brown |
| 3,082,824 | A | | 3/1963 | Taylor |
| 3,094,166 | A | | 6/1963 | McCullough |
| 3,160,209 | A | | 12/1964 | Bonner |
| 3,163,225 | A | | 12/1964 | Perkins |
| 3,270,819 | A | | 9/1966 | Thrane et al. |
| 3,273,588 | A | | 9/1966 | Dollison |
| 3,282,342 | A | | 11/1966 | Mott |
| 3,291,218 | A | | 12/1966 | Lebourg |
| 3,298,437 | A | | 1/1967 | Conrad |
| 3,298,440 | A | | 1/1967 | Current |
| 3,306,362 | A | | 2/1967 | Urbanosky |
| 3,308,895 | A | | 3/1967 | Oxford et al. |
| 3,356,140 | A | | 12/1967 | Young |
| 3,387,660 | A | | 6/1968 | Berryman |
| 3,393,743 | A | | 7/1968 | Stanescu |
| 3,429,375 | A | | 2/1969 | Craig |
| 3,517,742 | A | | 6/1970 | Williams |
| 3,554,280 | A | | 1/1971 | Tucker |
| 3,602,305 | A | | 8/1971 | Kisling |
| 3,623,551 | A | | 11/1971 | Randermann, Jr. |
| 3,687,202 | A | | 8/1972 | Young et al. |
| 3,787,101 | A | | 1/1974 | Sugden |
| 3,818,987 | A | | 6/1974 | Ellis |
| 3,851,706 | A | | 12/1974 | Ellis |
| 3,860,066 | A | | 1/1975 | Pearce et al. |
| 3,926,253 | A | | 12/1975 | Duke |
| 4,035,024 | A | | 7/1977 | Fink |
| 4,049,015 | A | | 9/1977 | Brown |
| 4,134,455 | A | | 1/1979 | Read |
| 4,151,875 | A | | 5/1979 | Sullaway |
| 4,185,689 | A | | 1/1980 | Harris |
| 4,189,183 | A | | 2/1980 | Borowski |
| 4,250,960 | A | | 2/1981 | Chammas |
| 4,314,608 | A | | 2/1982 | Richardson |
| 4,381,038 | A | | 4/1983 | Sugden |
| 4,391,547 | A | | 7/1983 | Jackson, Jr. et al. |
| 4,405,017 | A | | 9/1983 | Allen et al. |
| 4,432,418 | A | | 2/1984 | Mayland |
| 4,436,151 | A | | 3/1984 | Callihan et al. |
| 4,437,516 | A | | 3/1984 | Cockrell |
| 4,457,376 | A | | 7/1984 | Carmody et al. |
| 4,493,374 | A | | 1/1985 | Magee, Jr. |
| 4,532,995 | A | | 8/1985 | Kaufman |
| 4,548,442 | A | | 10/1985 | Sugden et al. |
| 4,554,981 | A | | 11/1985 | Davies |
| 4,556,541 | A | | 12/1985 | Gartside et al. |
| 4,566,541 | A | | 1/1986 | Moussy et al. |
| 4,585,067 | A | | 4/1986 | Blizzard et al. |
| 4,595,052 | A | | 6/1986 | Kristiansen |
| 4,602,654 | A | | 7/1986 | Stehling et al. |
| 4,688,641 | A | | 8/1987 | Knieriemen |
| 4,708,163 | A | | 11/1987 | Deaton |
| 4,708,202 | A | | 11/1987 | Sukup et al. |
| D293,798 | S | | 1/1988 | Johnson |
| 4,776,410 | A | | 10/1988 | Perkin et al. |
| 4,784,226 | A | | 11/1988 | Wyatt |
| 4,792,000 | A | | 12/1988 | Perkin et al. |
| 4,830,103 | A | | 5/1989 | Blackwell et al. |
| 4,848,459 | A | | 7/1989 | Blackwell et al. |
| 4,893,678 | A | | 1/1990 | Stokley et al. |
| 4,898,245 | A | | 2/1990 | Braddick |
| 5,020,590 | A | | 6/1991 | McLeod |
| 5,074,063 | A | | 12/1991 | Vannette |
| 5,082,061 | A | | 1/1992 | Dollison |
| 5,095,980 | A | | 3/1992 | Watson |
| 5,113,940 | A | | 5/1992 | Glaser |
| 5,117,915 | A | | 6/1992 | Mueller et al. |
| 5,154,228 | A | | 10/1992 | Gambertoglio et al. |
| 5,183,068 | A | | 2/1993 | Prosser |
| 5,188,182 | A | | 2/1993 | Echols, III et al. |
| 5,207,274 | A | | 5/1993 | Streich et al. |
| 5,209,310 | A | | 5/1993 | Clydesdale |
| 5,216,050 | A | | 6/1993 | Sinclair |
| 5,219,380 | A | | 6/1993 | Young et al. |
| 5,224,540 | A | | 7/1993 | Streich et al. |
| 5,230,390 | A | | 7/1993 | Zastresek et al. |
| 5,234,052 | A | | 8/1993 | Coone et al. |
| 5,253,705 | A | | 10/1993 | Clary et al. |
| 5,271,468 | A | | 12/1993 | Streich et al. |
| 5,295,735 | A | | 3/1994 | Cobbs et al. |
| 5,311,939 | A | | 5/1994 | Pringle et al. |
| 5,316,081 | A | | 5/1994 | Baski et al. |
| 5,318,131 | A | | 6/1994 | Baker |
| D350,887 | S | | 9/1994 | Sjolander et al. |
| 5,343,954 | A | | 9/1994 | Bohlen et al. |
| D353,756 | S | | 12/1994 | Graves |
| D355,428 | S | | 2/1995 | Hatcher |
| 5,390,737 | A | | 2/1995 | Jacobi et al. |
| 5,392,540 | A | | 2/1995 | Cooper et al. |
| 5,419,399 | A | | 5/1995 | Smith |
| RE35,088 | E | | 11/1995 | Gilbert |
| 5,484,191 | A | | 1/1996 | Sollami |
| 5,490,339 | A | | 2/1996 | Accettola |
| 5,540,279 | A | | 7/1996 | Branch et al. |
| 5,564,502 | A | | 10/1996 | Crow et al. |
| 5,593,292 | A | | 1/1997 | Ivey |
| D377,969 | S | | 2/1997 | Grantham |
| 5,655,614 | A | | 8/1997 | Azar |
| 5,688,586 | A | | 11/1997 | Shiiki et al. |
| 5,701,959 | A | | 12/1997 | Hushbeck et al. |
| 5,785,135 | A | | 7/1998 | Crawley et al. |
| 5,791,825 | A | | 8/1998 | Gardner et al. |
| 5,803,173 | A | | 9/1998 | Fraser, III et al. |
| 5,810,083 | A | | 9/1998 | Kilgore |
| 5,819,846 | A | | 10/1998 | Bolt, Jr. |
| 5,853,639 | A | | 12/1998 | Kawakami et al. |
| 5,908,917 | A | | 6/1999 | Kawakami et al. |
| D415,180 | S | | 10/1999 | Rosanwo |
| 5,961,185 | A | | 10/1999 | Friant et al. |
| 5,984,007 | A | | 11/1999 | Yuan et al. |
| 5,988,277 | A | | 11/1999 | Vick, Jr. et al. |
| 6,001,439 | A | | 12/1999 | Kawakami et al. |
| 6,012,519 | A | | 1/2000 | Allen et al. |
| 6,046,251 | A | | 4/2000 | Kawakami et al. |
| 6,082,451 | A | | 7/2000 | Giroux et al. |
| 6,085,446 | A | | 7/2000 | Posch |
| 6,098,716 | A | | 8/2000 | Hromas et al. |
| 6,105,694 | A | | 8/2000 | Scott |
| 6,142,226 | A | | 11/2000 | Vick |
| 6,152,232 | A | | 11/2000 | Webb et al. |
| 6,159,416 | A | | 12/2000 | Kawakami et al. |
| 6,167,963 | B1 | | 1/2001 | McMahan et al. |
| 6,182,752 | B1 | | 2/2001 | Smith, Jr. et al. |
| 6,183,679 | B1 | | 2/2001 | Kawakami et al. |
| 6,199,636 | B1 | | 3/2001 | Harrison |
| 6,220,349 | B1 | | 4/2001 | Vargus et al. |
| 6,245,437 | B1 | | 6/2001 | Shiiki et al. |
| 6,283,148 | B1 | | 9/2001 | Spears et al. |

(56) References Cited

U.S. PATENT DOCUMENTS 6,341,823 B1 1/2002 Sollami
6,367,569 B1 4/2002 Walk
6,394,180 B1 5/2002 Berscheidt et al.
6,457,267 B1 10/2002 Porter et al.
6,491,108 B1 12/2002 Slup et al.
6,543,963 B2 4/2003 Bruso
6,578,638 B2 6/2003 Guillory et al.
6,581,681 B1 6/2003 Zimmerman et al.
6,604,763 B1 8/2003 Cook et al.
6,629,563 B2 10/2003 Doane
6,673,403 B1 1/2004 Shiiki et al.
6,695,049 B2 2/2004 Ostocke et al.
6,708,768 B2 3/2004 Slup et al.
6,708,770 B2 3/2004 Slup et al.
6,725,935 B2 4/2004 Szarka et al.
6,739,398 B1 5/2004 Yokley et al.
6,769,491 B2 8/2004 Zimmerman et al.
6,779,948 B2 8/2004 Bruso
6,796,376 B2 9/2004 Frazier
6,799,633 B2 10/2004 McGregor
6,834,717 B2 12/2004 Bland
6,851,489 B2 2/2005 Hinds
6,852,827 B2 2/2005 Yamane et al.
6,854,201 B1 2/2005 Hunter et al.
6,891,048 B2 5/2005 Yamane et al.
6,902,006 B2 6/2005 Myerley et al.
6,916,939 B2 7/2005 Yamane et al.
6,918,439 B2 7/2005 Dallas
6,938,696 B2 9/2005 Dallas
6,944,977 B2 9/2005 Deniau et al.
6,951,956 B2 10/2005 Yamane et al.
7,017,672 B2 3/2006 Owen
7,021,389 B2 4/2006 Bishop et al.
7,040,410 B2 5/2006 McGuire et al.
7,055,632 B2 6/2006 Dallas
7,069,997 B2 7/2006 Coyes et al.
7,107,875 B2 9/2006 Haugen et al.
7,124,831 B2 10/2006 Turley et al.
7,128,091 B2 10/2006 Istre et al.
7,150,131 B2 12/2006 Barker
7,168,494 B2 1/2007 Starr et al.
7,235,673 B2 6/2007 Yamane et al.
7,281,584 B2 10/2007 McGarian et al.
D560,109 S 1/2008 Huang
7,325,617 B2 2/2008 Murray
7,337,847 B2 3/2008 McGarian et al.
7,350,582 B2 4/2008 McKeachnie et al.
7,353,879 B2 4/2008 Todd et al.
7,363,967 B2 4/2008 Burris, II et al.
7,373,973 B2 5/2008 Smith et al.
7,389,823 B2 * 6/2008 Turley et al. ..... 166/387
7,428,922 B2 9/2008 Fripp et al.
7,501,464 B2 3/2009 Sato et al.
7,527,104 B2 5/2009 Branch et al.
7,538,178 B2 5/2009 Sato et al.
7,538,179 B2 5/2009 Sato et al.
7,552,779 B2 6/2009 Murray
D597,110 S 7/2009 Anitua Aldecoa
7,600,572 B2 10/2009 Slup et al.
7,604,058 B2 10/2009 McGuire
7,622,546 B2 11/2009 Sato et al.
7,637,326 B2 12/2009 Bolding et al.
7,644,767 B2 1/2010 Kalb et al.
7,644,774 B2 1/2010 Branch et al.
D612,875 S 3/2010 Beynon
7,673,677 B2 3/2010 King et al.
7,690,436 B2 4/2010 Turley et al.
7,713,464 B2 5/2010 Nakajima et al.
D618,715 S 6/2010 Corcoran
7,728,100 B2 6/2010 Sato et al.
7,735,549 B1 6/2010 Nish et al.
7,740,079 B2 6/2010 Clayton et al.
7,775,286 B2 8/2010 Duphorne
7,775,291 B2 8/2010 Jacob et al.
7,781,600 B2 8/2010 Ogawa et al.
7,784,550 B2 8/2010 Nutley et al.
7,785,682 B2 8/2010 Sato et al.
7,798,236 B2 9/2010 McKeachnie et al.
7,799,837 B2 9/2010 Yamane et al.
7,810,558 B2 10/2010 Shkurti et al.
7,812,181 B2 10/2010 Ogawa et al.
D629,820 S 12/2010 Van Ryswyk
7,866,396 B2 1/2011 Rytlewski
7,878,242 B2 2/2011 Gray
7,886,830 B2 2/2011 Bolding et al.
7,900,696 B1 3/2011 Nish et al.
7,909,108 B2 3/2011 Swor et al.
7,909,109 B2 3/2011 Angman et al.
D635,429 S 4/2011 Hakki
7,918,278 B2 4/2011 Barbee
7,921,923 B2 4/2011 McGuire
7,921,925 B2 4/2011 MaGuire et al.
7,926,571 B2 4/2011 Hofman
7,976,919 B2 7/2011 Sato et al.
7,998,385 B2 8/2011 Yamane et al.
8,003,721 B2 8/2011 Suzuki et al.
8,039,548 B2 10/2011 Ogawa et al.
8,074,718 B2 12/2011 Roberts
8,079,413 B2 12/2011 Frazier
8,104,539 B2 1/2012 Stanojcic et al.
8,113,276 B2 2/2012 Greenlee et al.
8,119,699 B2 2/2012 Yamane et al.
8,127,856 B1 3/2012 Nish et al.
8,133,955 B2 3/2012 Sato et al.
D657,807 S 4/2012 Frazier
8,163,866 B2 4/2012 Sato et al.
8,230,925 B2 7/2012 Willberg et al.
8,231,947 B2 7/2012 Vaidya et al.
8,267,177 B1 9/2012 Vogel et al.
8,293,826 B2 10/2012 Hokari et al.
8,304,500 B2 11/2012 Sato et al.
8,318,837 B2 11/2012 Sato et al.
8,362,158 B2 1/2013 Sato et al.
8,404,868 B2 3/2013 Yamane et al.
8,424,610 B2 4/2013 Newton et al.
8,459,346 B2 6/2013 Frazier
8,496,052 B2 7/2013 Frazier
2001/0040035 A1 11/2001 Appleton et al.
2003/0024706 A1 2/2003 Allamon
2003/0188860 A1 10/2003 Zimmerman et al.
2004/0150533 A1 8/2004 Hall et al.
2005/0173126 A1 8/2005 Starr et al.
2005/0175801 A1 8/2005 Yamane et al.
2006/0001283 A1 1/2006 Bakke
2006/0011389 A1 1/2006 Booth
2006/0047088 A1 3/2006 Yamane et al.
2006/0278405 A1 12/2006 Turley et al.
2007/0051521 A1 3/2007 Fike et al.
2007/0068670 A1 3/2007 Booth
2007/0107908 A1 5/2007 Vaidya et al.
2007/0151722 A1 7/2007 Lehr et al.
2007/0227745 A1 10/2007 Roberts et al.
2007/0240883 A1 10/2007 Telfer
2008/0060821 A1 3/2008 Smith et al.
2008/0110635 A1 5/2008 Loretz et al.
2009/0044957 A1 2/2009 Clayton et al.
2009/0081396 A1 3/2009 Hokari et al.
2009/0114401 A1 5/2009 Purkis
2009/0126933 A1 5/2009 Telfer
2009/0211749 A1 8/2009 Nguyen et al.
2010/0064859 A1 3/2010 Stephens
2010/0084146 A1 4/2010 Roberts
2010/0093948 A1 4/2010 Sato et al.
2010/0101807 A1 4/2010 Greenlee et al.
2010/0132960 A1 6/2010 Shkurti et al.
2010/0155050 A1 6/2010 Frazier
2010/0184891 A1 7/2010 Akutsu et al.
2010/0215858 A1 8/2010 Yamane et al.
2010/0252252 A1 10/2010 Harris et al.
2010/0263876 A1 10/2010 Frazier
2010/0276159 A1 11/2010 Mailand et al.
2010/0286317 A1 11/2010 Sato et al.
2010/0288503 A1 11/2010 Cuiper et al.
2011/0005779 A1 1/2011 Lembcke

(56) References Cited

U.S. PATENT DOCUMENTS

| | | | |
|---|---|---|---|
| 2011/0008578 | A1 | 1/2011 | Yamane et al. |
| 2011/0027590 | A1 | 2/2011 | Abe |
| 2011/0036564 | A1 | 2/2011 | Williamson |
| 2011/0061856 | A1 | 3/2011 | Kellner et al. |
| 2011/0088915 | A1 | 4/2011 | Stanojcic et al. |
| 2011/0103915 | A1 | 5/2011 | Tedeschi |
| 2011/0104437 | A1 | 5/2011 | Yamamura et al. |
| 2011/0108185 | A1 | 5/2011 | Hokari et al. |
| 2011/0168404 | A1 | 7/2011 | Telfer et al. |
| 2011/0190456 | A1 | 8/2011 | Itoh et al. |
| 2011/0198082 | A1 | 8/2011 | Stromquist et al. |
| 2011/0240295 | A1 | 10/2011 | Porter et al. |
| 2011/0259610 | A1 | 10/2011 | Shkurti et al. |
| 2011/0263875 | A1 | 10/2011 | Suzuki et al. |
| 2012/0046414 | A1 | 2/2012 | Sato et al. |
| 2012/0086147 | A1 | 4/2012 | Sato et al. |
| 2012/0125642 | A1 | 5/2012 | Chenault et al. |
| 2012/0130024 | A1 | 5/2012 | Sato et al. |
| 2012/0156473 | A1 | 6/2012 | Suzuki et al. |
| 2012/0193835 | A1 | 8/2012 | Suzuki et al. |
| 2012/0270048 | A1 | 10/2012 | Saigusa et al. |
| 2012/0289713 | A1 | 11/2012 | Suzuki et al. |
| 2013/0079450 | A1 | 3/2013 | Sato et al. |
| 2013/0081801 | A1 | 4/2013 | Liang et al. |
| 2013/0081813 | A1 | 4/2013 | Liang et al. |
| 2013/0087061 | A1 | 4/2013 | Marya et al. |

FOREIGN PATENT DOCUMENTS

| | | |
|---|---|---|
| WO | WO02070508 | 12/2002 |
| WO | WO03006525 | 1/2003 |
| WO | WO03006526 | 1/2003 |
| WO | WO03037956 | 5/2003 |
| WO | WO03074092 | 9/2003 |
| WO | WO03090438 | 10/2003 |
| WO | WO03099562 | 12/2003 |
| WO | WO2004033527 | 4/2004 |
| WO | WO2005044894 | 5/2005 |
| WO | WO2006064611 | 1/2006 |
| WO | WO2010127457 | 11/2010 |

OTHER PUBLICATIONS

"78/79 Catalog: Packers—Plugs—Completions Tools," Pengo Industries, Inc., 1978-1979 (12 pages).
"MAP Oil Tools Inc. Catalog," MAP Oil Tools, Apr. 1999 (46 pages).
"Lovejoy—where the world turns for couplings," Lovejoy, Inc., Dec. 2000 (30 pages).
"Halliburton Services, Sales & Service Catalog," Halliburton Services, 1970-1971 (2 pages).
"1975-1976 Packer Catalog," Gearhart-Owen Industries Inc., 1975-1976 (52 pages).
"Formation Damage Control Utilizing Composite-Bridge Plug Technology for Monobore, Multizone Stimulation Operations," Gary Garfield, SPE, May 15, 2001 (8 pages).
"Composite Bridge Plug Technique for Multizone Commingled Gas Wells," Gary Garfield, SPE, Mar. 24, 2001 (6 pages).
"Composite Research: Composite bridge plugs used in multi-zone wells to avoid costly will-weight fluids," Gary Garfield, SPE, Mar. 24, 2001 (4 pages).
"It's About Time—Quick Drill Composite Bridge Plug," Baker Oil Tools, Jun. 2002 (2 pages).
"Baker Hughes-Baker Oil Tools—Workover Systems—QUIK Drill Composite Bridge Plug," Baker Oil Tools, Dec. 2000 (3 pages).
"Baker Hughes 100 Years of Service," Baker Hughes in Depth, Special Centennial Issue, Publication COR-07-13127, vol. 13, No. 2, Baker Hughes Incorporated, Jul. 2007 (92 pages).
"Halliburton Services, Sales & Service Catalog No. 43," Halliburton Co., 1985 (202 pages).
"Alpha Oil Tools Catalog," Alpha Oil Tools, 1997 (136 pages).
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley.
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley; Paper No. 31, Final Written Decision entered Sep. 2, 2014.
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley; Paper No. 33, Decision on Request for Rehearing entered Oct. 29, 2014.
Petition for Inter Partes Review for U.S. Pat. No. 8,079,413 (U.S. Appl. No. 13/194,871); Case No. 2013-00231; Filed Apr. 2, 2013; Administrative Patent Judge Sally C. Medley; Paper No. 35, Notice of Appeal entered Dec. 23, 2014.
Petition for Inter Partes Review for U.S. Pat. No. 8,459,346 (U.S. Appl. No. 13/329,077); Case No. 2014-00993; Filed Jun. 19, 2014; Administrative Patent Judge Sally C. Medley; Paper No. 14, Decision to Institute Trial entered Dec. 1, 2014.
Petition for Inter Partes Review for U.S. Pat. No. 8,459,346 (U.S. Appl. No. 13/329,077); Case No. 2014-00993; Filed Jun. 19, 2014; Administrative Patent Judge Sally C. Medley; Paper No. 18, Termination of the Proceeding entered Dec. 11, 2014.

* cited by examiner

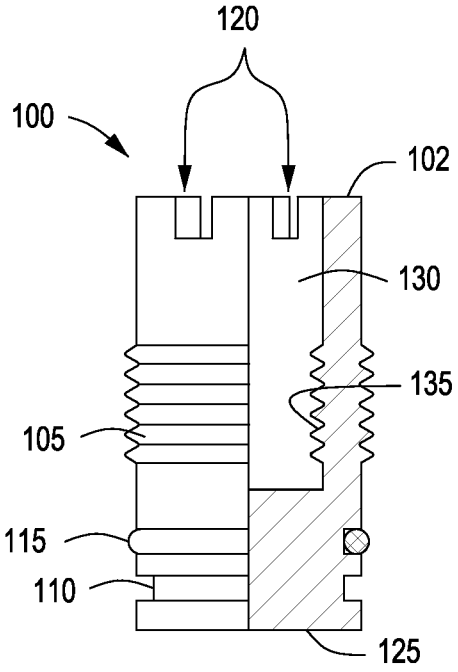
FIG. 1
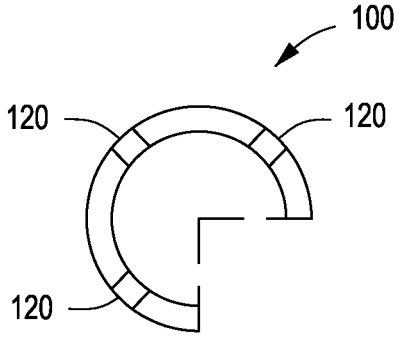
FIG. 2
FIG. 3
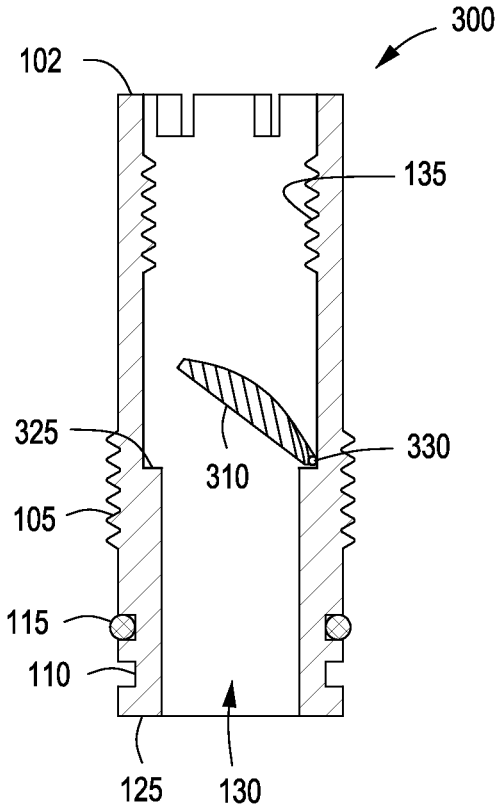

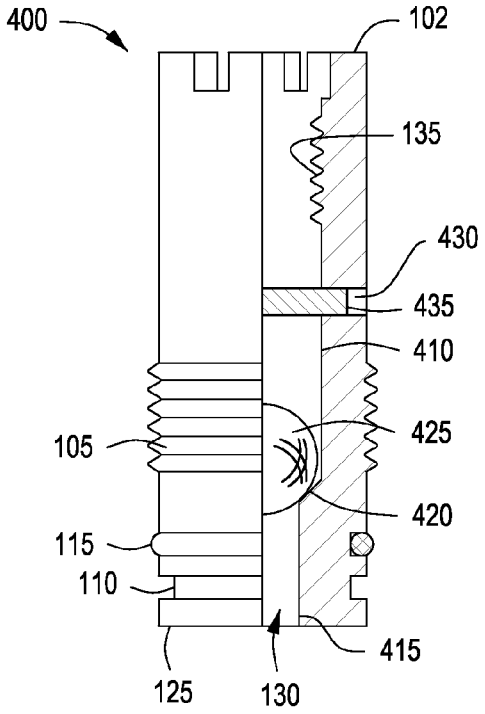
FIG. 4A
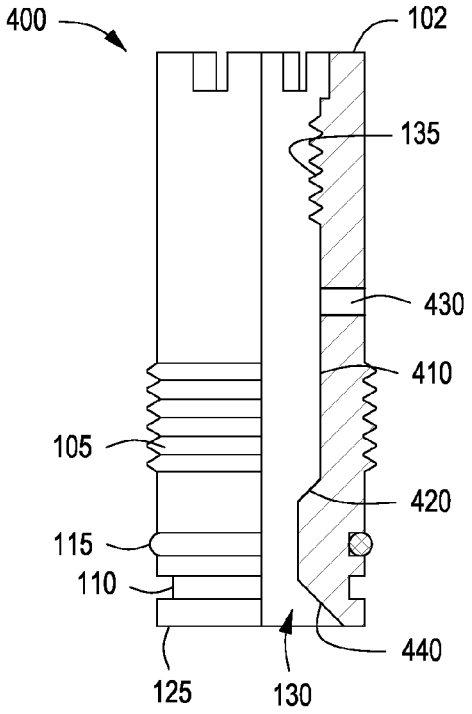
FIG. 4B
FIG. 5
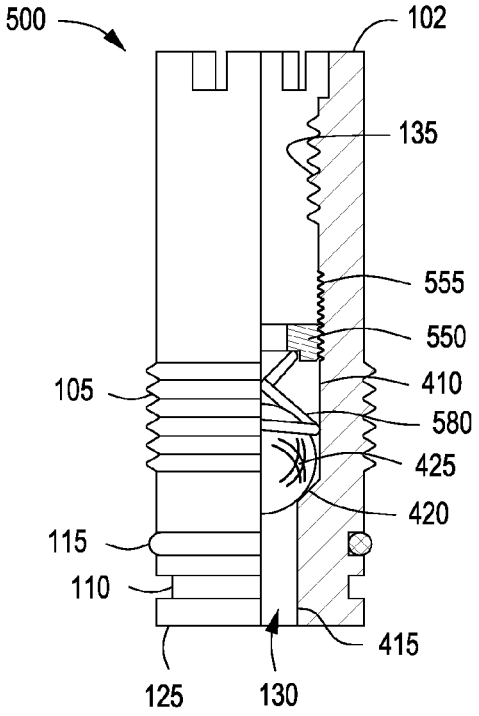

CONFIGURABLE DOWNHOLE TOOLS AND METHODS FOR USING SAME

CROSS-REFERENCE TO RELATED APPLICATIONS

This application is a continuation-in-part of U.S. Patent Application having Ser. No. 13/194,820, filed on Jul. 29, 2011, which is a continuation-in-part of U.S. Patent Application having Ser. No. 12/799,231, filed on Apr. 21, 2010, which claims priority to U.S. Provisional Patent Application having Ser. No. 61/214,347, filed on Apr. 21, 2009, all of which are incorporated by reference in their entirety.

BACKGROUND

1. Field

Embodiments described generally relate to downhole tools. More particularly, embodiments described relate to an insert that can be engaged in downhole tools for controlling fluid flow through one or more zones of a wellbore.

2. Description of the Related Art

Bridge plugs, frac plugs, and packers are downhole tools that are typically used to permanently or temporarily isolate one wellbore zone from another. Such isolation is often necessary to pressure test, perforate, frac, or stimulate a zone of the wellbore without impacting or communicating with other zones within the wellbore. To reopen and/or restore fluid communication through the wellbore, plugs are typically removed or otherwise compromised.

Permanent, non-retrievable plugs and/or packers are typically drilled or milled to remove. Most non-retrievable plugs are constructed of a brittle material such as cast iron, cast aluminum, ceramics, or engineered composite materials, which can be drilled or milled. Problems sometimes occur, however, during the removal or drilling of such non-retrievable plugs. For instance, the non-retrievable plug components can bind upon the drill bit, and rotate within the casing string. Such binding can result in extremely long drill-out times, excessive casing wear, or both. Long drill-out times are highly undesirable, as rig time is typically charged by the hour.

In use, non-retrievable plugs are designed to perform a particular function. A bridge plug, for example, is typically used to seal a wellbore such that fluid is prevented from flowing from one side of the bridge plug to the other. On the other hand, drop ball plugs allow for the temporary cessation of fluid flow in one direction, typically in the downhole direction, while allowing fluid flow in the other direction. Depending on user preference, one plug type may be advantageous over another, depending on the completion and/or production activity.

Certain completion and/or production activities may require several plugs run in series or several different plug types run in series. For example, one well may require three bridge plugs and five drop ball plugs, and another well may require two bridge plugs and ten drop ball plugs for similar completion and/or production activities. Within a given completion and/or production activity, the well may require several hundred plugs and/or packers depending on the productivity, depths, and geophysics of each well. The uncertainty in the types and numbers of plugs that might be required typically leads to the over-purchase and/or under-purchase of the appropriate types and numbers of plugs resulting in fiscal inefficiencies and/or field delays.

There is a need, therefore, for a downhole tool that can effectively seal the wellbore at wellbore conditions; be quickly, easily, and/or reliably removed from the wellbore; and configured in the field to perform one or more functions.

BRIEF DESCRIPTION OF THE DRAWINGS

Non-limiting, illustrative embodiments are depicted in the drawings, which are briefly described below. It is to be noted, however, that these illustrative drawings illustrate only typical embodiments and are not to be considered limiting of its scope, for the invention can admit to other equally effective embodiments.

FIG. 1 depicts a partial section view of an illustrative insert for use with a plug, according to one or more embodiments described.

FIG. 2 depicts a top view of the insert shown in FIG. 1, according to one or more embodiments described.

FIG. 3 depicts a partial section view of another illustrative insert for use with the plug, according to one or more embodiments described.

FIG. 4A depicts a partial section view of another illustrative insert for use with the plug, according to one or more embodiments described.

FIG. 4B depicts a partial section view of another illustrative embodiment of the insert shown in FIG. 4A, according to one or more embodiments described.

FIG. 5 depicts a partial section view of another illustrative insert for use with the plug, according to one or more embodiments described.

DETAILED DESCRIPTION

Figure 6A:
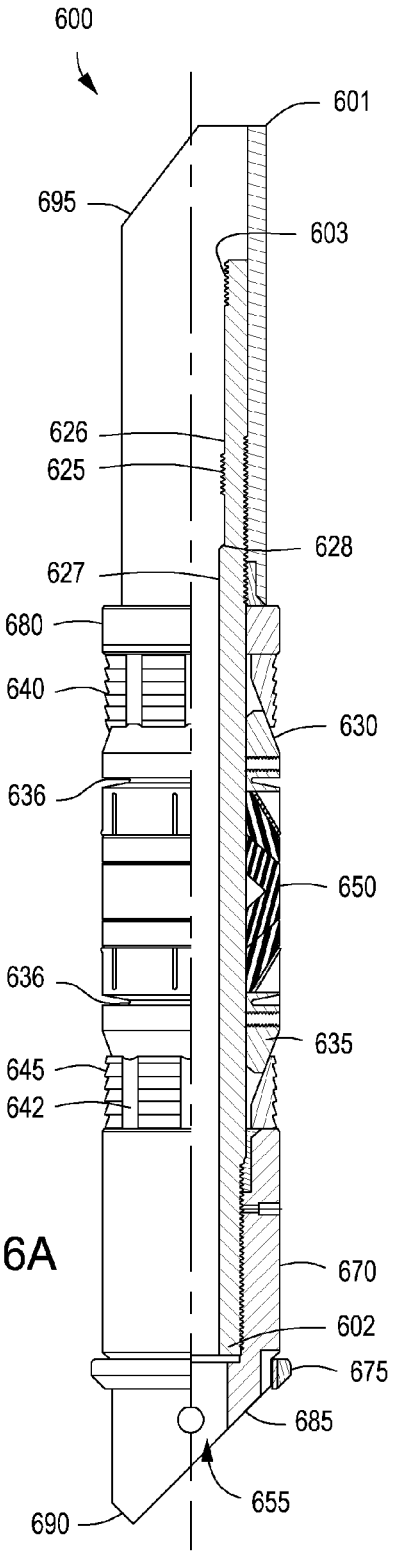
FIG. 6A depicts a partial section view of an illustrative plug for downhole use, according to one or more embodiments described.

FIG. 1 depicts a partial section view of an illustrative insert 100 for use with a plug, and FIG. 2 depicts a top plan view of the illustrative insert 100, according to one or more embodiments. The insert 100 can include a first or upper end 102 and a second or lower end 125. One or more threads 105 can be disposed or formed on an outer surface of the insert 100. The outer threads 105 can be disposed on the outer surface of the insert 100 toward the upper end 102, the lower end 125, or anywhere therebetween. As discussed in more detail below with reference to FIGS. 6A-6E, the outer threads 105 can be used to secure the insert 100 within a surrounding component, such as a plug, another insert 100, a setting tool, a tubing string, or other tool.

The outer threads 105 can be right-handed and/or left-handed threads. For example, to facilitate connection of the insert 100 to a plug, the outer threads 105 can be right-handed threads and the plug threads can be left-handed threads, or vice versa. Any number of outer threads 105 can be used. The number, pitch, pitch angle, and/or depth of the outer threads 105 can depend, at least in part, on the operating conditions of the wellbore where the insert 100 will be used. The number, pitch, pitch angle, and/or depth of the outer threads 105 can also depend, at least in part, on the materials of construction of both the insert 100 and the component, e.g., another insert 100, a setting tool, another tool, plug, tubing string, etc., to which the insert 100 is connected. The number of outer threads 105, for example, can range from about 2 to about 100, such as about 2 to about 50; about 3 to about 25; or about 4 to about 10. The number of outer threads 105 can also range from a low of about 2, 4, or 6 to a high of about 7, 12, or 20. The pitch between each outer thread 105 can also vary. The pitch between each outer thread 105 can be the same or different. For example, the pitch between each outer thread 105 can vary from about 0.1 mm to about 200 mm; 0.2 mm to about 150 mm; 0.3 mm to about 100 mm; or about 0.1 mm to about 50 mm. The pitch between each outer thread 105 can also range from a low of about 0.1 mm, 0.2 mm, or 0.3 mm to a high of about 2 mm, 5 mm or 10 mm.

The outer surface of the insert 100 can have a constant diameter, or its diameter can vary (not shown). For example, the outer surface can include a smaller, first diameter portion or area that transitions to a larger, second diameter portion or area, forming a ledge or shoulder therebetween. The shoulder can have a first end that is substantially flat, abutting the second diameter, and a second end that gradually slopes or transitions to the first diameter and can be adapted to anchor the insert 100 into the plug. The shoulder can be formed adjacent the outer threads 105 or spaced apart therefrom, and the outer threads 105 can be above or below the shoulder.

The terms "up" and "down"; "upward" and "downward"; "upper" and "lower"; "upwardly" and "downwardly"; "upstream" and "downstream"; "above" and "below"; and other like terms as used herein refer to relative positions to one another and are not intended to denote a particular spatial orientation since the tool and methods of using same can be equally effective in either horizontal or vertical wellbore uses.

The insert 100 can include one or more circumferential channels 110 disposed or otherwise formed on the outer surface thereof. The one or more channels 110 can be disposed on the outer surface of the insert 100 and proximate the lower end 125 of the insert 100. A sealing material 115, such as an elastomeric O-ring, can be disposed within the one or more channels 110 to provide a fluid seal between the insert 100 and the plug with which the insert 100 can be engaged. Although the outer surface or outer diameter of the lower end 125 of the configurable insert 100 is depicted as being uniform, the outer surface or diameter of the lower end 125 can be tapered.

The top of the upper end 102 of the insert 100 can include an upper surface interface 120 for engaging one or more tools to locate and tighten the configurable insert 100 within the plug. The upper surface interface 120 can be, without limitation, hexagonal, slotted, notched, cross-head, square, torx, security torx, tri-wing, torq-set, spanner head, triple square, polydrive, one-way, spline drive; double hex, Bristol, Pentalobular, or any other known surface shape capable of being engaged.

A passageway or bore 130 can be at least partially (as shown in FIG. 1) or completely (see FIGS. 3, 4A, 4B, and 5) formed through the insert 100. When the bore 130 extends only partially through the insert 100, fluid is unable to flow through the insert 100. However, when the bore 130 extends completely through the insert 100, fluid can flow through the insert 100 in one or both directions.

The insert 100 can include one or more shear mechanisms 135. The terms "shear mechanism" and "shearable mechanism" are used interchangeably, and are intended to refer to any component, part, element, member, or thing that shears or is capable of shearing at a predetermined force that is less than the force required to shear the body of the insert and/or the plug. The term "shear" means to fracture, break, or otherwise deform thereby releasing two or more engaged components, parts, or things or thereby partially or fully separating a single component into two or more components/pieces.

The shear mechanism 135 can be or include shearable threads, a shear groove, a shear pin, or the like. As shown, one or more shearable threads 135 can be disposed or formed on an inner surface of the insert 100. The shearable threads 135 can be used to couple the insert 100 to a setting tool, another insert 100, a plug, a tubing string, or other tool. The shearable threads 135 can be located anywhere along the inner surface of the insert 100, and are not dependent on the location of the outer threads 105. For example, the shearable threads 135 can be located above, below, or adjacent to the outer threads 105, or the shearable threads 135 can be located proximate the upper end 102, the lower end 125, or anywhere therebetween.

Any number of shearable threads 135 can be used. The number, pitch, pitch angle, and/or depth of shearable threads 135 can depend, at least in part, on the operating conditions of the wellbore where the insert 100 will be used. The number, pitch, pitch angle, and/or depth of the shearable threads 135 can also depend, at least in part, on the materials of construction of both the insert 100 and the component, e.g., a setting tool, another insert 100, a plug, a tubing string, etc., to which the insert 100 is connected. The number of shearable threads 135, for example, can range from about 2 to about 100, such as about 2 to about 50; about 3 to about 25; or about 4 to about 10. The number of shearable threads 135 can also range from a low of about 2, 4, or 6 to a high of about 7, 12, or 20. The pitch between each shearable thread 135 can also vary. The pitch between each shearable thread 135 can be the same or different. For example, the pitch between each shearable thread 135 can vary from about 0.1 mm to about 200 mm; 0.2 min to about 150 mm; 0.3 mm to about 100 mm; or about 0.1 mm to about 50 mm. The pitch between each shearable thread 135 can also range from a low of about 0.1 mm, 0.2 mm, or 0.3 mm to a high of about 2 mm, 5 mm, or 10 mm.

The shearable threads 135 can be adapted to shear, break, or otherwise deform when exposed to a predetermined stress or force, releasing the component engaged within the insert 100. The predetermined stress or force can be less than a stress or force required to shear or break the body of the insert 100 or the outer threads 105 of the insert 100. Upon the shearing, breaking, or deforming, the component engaged within the insert 100, e.g., a setting tool, can be freely removed or separated therefrom.

FIG. 3 depicts a partial section view of another illustrative insert 300, according to one or more embodiments. The bore 130 of the insert 300 can have a constant diameter (see FIG. 1), or the diameter can vary (as shown in FIG. 3). For example, the bore 130 can include a smaller, first diameter portion or area that transitions to a larger, second diameter portion or area to form a ledge or shoulder 325 therebetween. The shoulder 325 can be adapted to receive a flapper valve member 310 that can be contained within the bore 130 using a pivot pin 330. Although not shown, the insert 300 can be further adapted to include a tension member that can urge the flapper valve member 310 into either an open or closed position, as discussed in more detail below.

FIG. 4A depicts a partial section view of another illustrative insert 400, according to one or more embodiments. The bore 130 of the insert 400 can have a constant diameter, or the diameter can vary. For example, the bore 130 can include a smaller, first diameter portion or area 415 that transitions to a larger, second diameter portion or area 410 to form a ledge or shoulder 420 therebetween. The shoulder 420 can gradually slope or transition from the first diameter portion or area 415 to the second diameter portion or area 410. The shoulder 420 can be adapted to receive a solid impediment, such as a ball 425, which can be contained within the bore 130 using a pin 435 that can be inserted into an aperture 430 of the insert 400. The pin 435 restricts movement of the ball 425 to within the length of the bore 130 between the shoulder 420 and the pin 435. In such a configuration, the ball 425 permits fluid flow from the lower end 125 toward the upper end 102; however, fluid flow is restricted or prevented from the upper end 102 toward the lower end 125 when the ball 425 creates a seal against the shoulder 420. The pin 434 prevents the ball 425 from escaping the bore 130 when fluid is moving from the lower end 125 toward the upper end 102.

FIG. 4B depicts a partial section view of another illustrative embodiment of the insert 400, according to one or more embodiments. The bore 130 of the insert 400 can have a varying diameter, for example, the bore 130 of the insert 400 can include a smaller diameter portion or area 410 that transitions to a larger diameter portion or area forming a seat or shoulder 420, and at least one additional portion or area that transitions to at least one smaller diameter portion or area, forming at least one seat or shoulder therein. For example, a second seat or shoulder 440 can be formed towards the lower end 125 of the insert 100 in a transition between a smaller diameter portion or area and a larger diameter portion or area. The shoulder 440 can accept a solid impediment, e.g., a ball, to prevent fluid flow through the bore 130 from the lower end 125 toward the upper end 102, as the ball makes a fluid seal against the shoulder 440.

FIG. 5 depicts a partial section view of another illustrative insert 500, according to one or more embodiments. The insert 500 can include a second set of inner threads 555 disposed on the inner surface of the bore 130. The threads 555 can be located toward, near, or at an upper end 102 of the insert 500, the lower end 125 of the insert 500, or anywhere therebetween. For example, the threads 555 can be located closer to the lower end 125 of the insert 500 than the shearable threads 135. In one or more embodiments, the threads 555 can engage an impediment, such as a ball stop 550, as shown. The ball stop 550 can be coupled in the bore 130 via the threads 555, such that the ball stop 550 can be easily inserted in the field. Further, the ball stop 550 can be configured to retain a ball 425 in the bore 130 between the ball stop 550 and the shoulder 420. The ball 425 can be shaped and sized to provide a fluid tight seal against the seat or shoulder 420, 440 to restrict fluid movement through the bore 130 in the insert 500. However, the ball 425 need not be entirely spherical, and can be provided as any size and shape suitable to seat against the seat or shoulder 420, 440.

Accordingly, the ball stop 550 and the ball 425 can provide a one-way check valve. As such, fluid can generally flow from the lower end 125 of the insert 500 to and out through the upper end 102 thereof; however, the bore 130 may be sealed from fluid flowing from the upper end 102 of the insert 500 toward the lower end 125. The ball stop 550 can be a plate, annular cover, a ring, a bar, a cage, a pin, or other component capable of preventing the ball 425 from moving past the ball stop 550 in the direction towards the upper end 102 of the insert 500. Further, the ball stop 550 can retain a tension member 580, such as a spring, to urge the solid impediment or ball 425 to more tightly seal against the seat or shoulder 420 of the insert 500.

The insert 100, 300, 400, 500 and/or the threads 105, 135, 555 can be made of an alloy that includes brass. Suitable brass compositions include, but are not limited to, admiralty brass, Aich's alloy, alpha brass, alpha-beta brass, aluminum brass, arsenical brass, beta brass, cartridge brass, common brass, dezincification resistant brass, gilding metal, high brass, leaded brass, lead-free brass, low brass, manganese brass, Muntz metal, nickel brass, naval brass, Nordic gold, red brass, rich low brass, tonval brass, white brass, yellow brass, and/or any combinations thereof.

The insert 100, 300, 400, 500 can also be formed or made from other metallic materials (such as aluminum, steel, stainless steel, copper, nickel, cast iron, galvanized or non-galvanized metals, etc.), fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymetbacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

FIG. 6A depicts a partial section view of an illustrative plug 600, according to one or more embodiments. The term "plug" refers to any tool used to permanently or temporarily isolate one wellbore zone from another, including any tool with blind passages, plugged mandrels, as well as open passages extending completely therethrough and passages that are blocked with a check valve. Such tools are commonly referred to in the art as "bridge plugs," "frac plugs," and/or "packers." And, such tools can be a single assembly (i.e., one plug) or two or more assemblies (i.e., two or more plugs) disposed within a work string or otherwise connected thereto that is run into a wellbore on a wireline, slickline, production tubing, coiled tubing or any technique known or yet to be discovered in the art.

The plug 600 can include a mandrel or body 608 having a first end 601 and a second end 602. The body 608 can have a passageway or bore 655 formed at least partially therethrough. The body 608 can be a single, monolithic component as shown, or the body 608 can be or include two or more components connected, engaged, or otherwise attached together. The body 608 serves as a centralized support member, made of one or more components or parts, for one or more outer components to be disposed thereon or thereabout.

The bore 655 can have a constant diameter throughout, or the diameter can vary, as depicted in FIGS. 6A-6E. For example, the bore 655 can include a larger, first diameter portion or area 626 that transitions to a smaller, second diameter portion or area 627, forming a seat or shoulder 628 therebetween. The shoulder 628 can have a tapered or sloped surface connecting the two diameter portions 626, 627. Although not shown, the shoulder 628 can be flat or substantially flat, providing a horizontal or substantially horizontal surface connecting the two diameter portions 626, 627. As will be explained in more detail below, the shoulder 628 can serve as a seat or receiving surface for plugging off the bore 655 when an insert 100, 300, 400, 500 or other solid object is coupled, for example, screwed into or otherwise placed within the bore 655.

At least one conical member (two are shown: 630, 635), at least one slip (two are shown: 640, 645), and at least one malleable element 650 can be disposed about the body 608. As used herein, the term "disposed about" means surrounding the component, e.g., the body 608, allowing for relative movement therebetween (e.g., by sliding, rotating, pivoting, or a combination thereof). A first section or first end of the conical members 630, 635 can include a sloped surface adapted to rest underneath a complementary sloped inner surface of the slips 640, 645. As explained in more detail below, the slips 640, 645 can travel about the surface of the adjacent conical members 630, 635, thereby expanding radially outward from the body 608 to engage an inner surface of a surrounding tubular or borehole. A second section or second end of the conical members 630, 635 can include two or more tapered petals or wedges adapted to rest about the adjacent malleable element 650. One or more circumferential voids 636 can be disposed within or between the first and second sections of the conical members 630, 635 to facilitate expansion of the wedges about the malleable element 650. The wedges are adapted to hinge or pivot radially outward and/or hinge or pivot circumferentially. The groove or void 636 can facilitate such movement. The wedges pivot, rotate, or otherwise extend radially outward, and can contact an inner diameter of the surrounding tubular or borehole. Additional details of the conical members 630, 635 are described in U.S. Pat. No. 7,762,323.

The inner surface of each slip 640, 645 can conform to the first end of the adjacent conical member 630, 635. An outer surface of the slips 640, 645 can include at least one outwardly-extending serration or edged tooth to engage an inner surface of a surrounding tubular as the slips 640, 645 move radially outward from the body 608 due to the axial movement across the adjacent conical members 630, 635.

The slips 640, 645 can be designed to fracture with radial stress. The slips 640, 645 can include at least one recessed groove 642 milled or otherwise formed therein to fracture under stress allowing the slips 640, 645 to expand outward and engage an inner surface of the surrounding tubular or borehole. For example, the slips 640, 645 can include two or more, for example, four, sloped segments separated by equally-spaced recessed grooves 642 to contact the surrounding tubular or borehole.

The malleable element 650 can be disposed between the conical members 630, 635. A three element 650 system is depicted in FIGS. 6A-6E, 7, and 8; but any number of elements 650 can be used. The malleable element 650 can be constructed of any one or more malleable materials capable of expanding and sealing an annulus within the wellbore. The malleable element 650 is preferably constructed of one or more synthetic materials capable of withstanding high temperatures and pressures, including temperatures up to 450° F., and pressure differentials up to 15,000 psi. Illustrative materials include elastomers, rubbers, TEFLON, blends and combinations thereof.

The malleable element(s) 650 can have any number of configurations to effectively seal the annulus defined between the body 608 and the wellbore. For example, the malleable element(s) 650 can include one or more grooves, ridges, indentations, or protrusions designed to allow the malleable element(s) 650 to conform to variations in the shape of the interior of the surrounding tubular or borehole.

At least one component, ring, or other annular member 680 for receiving an axial load from a setting tool can be disposed about the body 608 adjacent a first end of the slip 640. The annular member 680 for receiving the axial load can have first and second ends that are substantially flat. The first end can serve as a shoulder adapted to abut a setting tool (not shown). The second end can abut the slip 640 and transmit axial forces therethrough.

Each end of the plug 600 can be the same or different. Each end of the plug 600 can include one or more anti-rotation features 670 disposed thereon. Each anti-rotation feature 670 can be screwed on, formed on, or otherwise connected to or positioned about the body 608 so that there is no relative motion between the anti-rotation feature 670 and the body 608. Alternatively, each anti-rotation feature 670 can be screwed on or otherwise connected to or positioned about a shoe, nose, cap, or other separate component, which can be made of composite, that is screwed onto threads, or otherwise connected to or positioned about the body 608 so that there is no relative motion between the anti-rotation feature 670 and the body 608. The anti-rotation feature 670 can have various shapes and forms. For example, the anti-rotation feature 670 can be or can resemble a mule shoe shape (not shown), half-mule shoe shape (illustrated in FIG. 9), flat protrusions or flats (illustrated in FIGS. 11 and 12), clutches (illustrated in FIG. 10), or otherwise angled surfaces 685, 690, 695 (illustrated in FIGS. 6A-6E, 7, 8 and 9).

As explained in more detail below, the anti-rotation features 670 are intended to engage, connect, or otherwise contact an adjacent plug, whether above or below the adjacent plug, to prevent or otherwise retard rotation therebetween, facilitating faster drill-out or mill times. For example, the angled surfaces 685, 690 at the bottom of the first plug 600 can engage the sloped surface 695 of a second plug 600 in series, so that relative rotation therebetween is prevented or greatly reduced.

A pump down collar 675 can be located about a lower end of the plug 600 to facilitate delivery of the plug 600 into the wellbore. The pump down collar 675 can be a rubber O-ring or similar sealing member to create an impediment in the wellbore during installation, so that a push surface or resistance can be created.

One or more threads 603 can be formed or disposed on an inner surface of the body 608. The threads 603 can be formed anywhere along the inner surface of the body 608. In at least one embodiment, the threads 603 can be located proximate the first end 601 of the body 608. For example, the threads 603 can be located above the shoulder 628, the conical member 630, the slip 640, the malleable element 650, and/or the annular member 680. The threads 603 can also be located above one or more shear grooves (not shown) formed in the body 608.

In at least one embodiment, the threads 603 can be shearable threads that are adapted to receive the adapter rod of a setting tool. Any number of shearable threads 603 can be used. The number, pitch, pitch angle, and/or depth of shearable threads 603 can depend, at least in part, on the operating conditions of the wellbore where the plug 600 will be used. The number, pitch, pitch angle, and/or depth of the shearable threads 603 can also depend, at least in part, on the materials of construction of both the plug 600 and the component, e.g., a setting tool, insert 100, 300, 400, 500, another tool, plug, tubing string, etc., to which the plug 600 is connected. The number of shearable threads 603, for example, can range from about 2 to about 100, such as about 2 to about 50; about 3 to about 25; or about 4 to about 10. The number of shearable threads 603 can also range from a low of about 2, 4, or 6 to a high of about 7, 12, or 20. The pitch between each shearable thread 603 can also vary. The pitch between each shearable thread 603 can be the same or different. For example, the pitch between each shearable thread 603 can vary from about 0.1 mm to about 200 mm; 0.2 mm to about 150 mm; 0.3 mm to about 100 mm; or about 0.1 mm to about 50 mm. The pitch between each shearable thread 603 can also range from a low of about 0.1 mm, 0.2 mm, or 0.3 mm to a high of about 2 mm, 5 mm or 10 mm.

As described in more detail below, the shearable threads 603 can be adapted to shear, break, or otherwise deform when exposed to a predetermined stress or force, releasing the component engaged within the plug 600, e.g., a setting tool. The predetermined stress or force can be less than a stress or force required to shear or break the body 608 of the plug 600. Upon the shearing, breaking, or deforming, the component engaged within the plug 600 can be freely removed or separated therefrom.

Figure 6B:
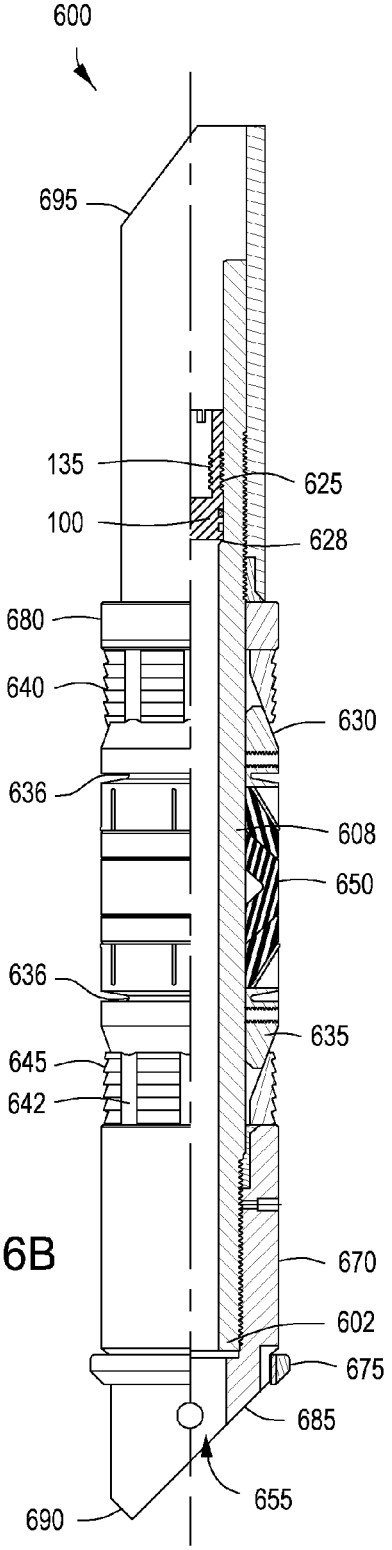
FIG. 6B depicts a partial section view of the plug configured with the insert shown in FIG. 1, according to one or more embodiments described.

FIG. 6B depicts a partial section view of the plug 600 configured with the insert 100, according to one or more embodiments. One or more threads 625 can be disposed or formed on the inner surface of the plug 600. In at least one embodiment, the threads 625 can be located proximate the first end 601 of the body 608. For example, the threads 625 can be located above the shoulder 628, the conical member 630, the slip 640, the malleable element 650, and/or the annular member 680. The threads 603 can also be located below the shearable threads 603 and/or below a shear groove (not shown) formed in the body 608. The threads 625 can be adapted to receive the outer threads 105 of the insert 100. When the insert 100 is threadably engaged with the plug 600, the insert 100 can be adapted to prevent fluid from flowing through the bore 655 of the plug 600 in both directions.

Figure 6C:
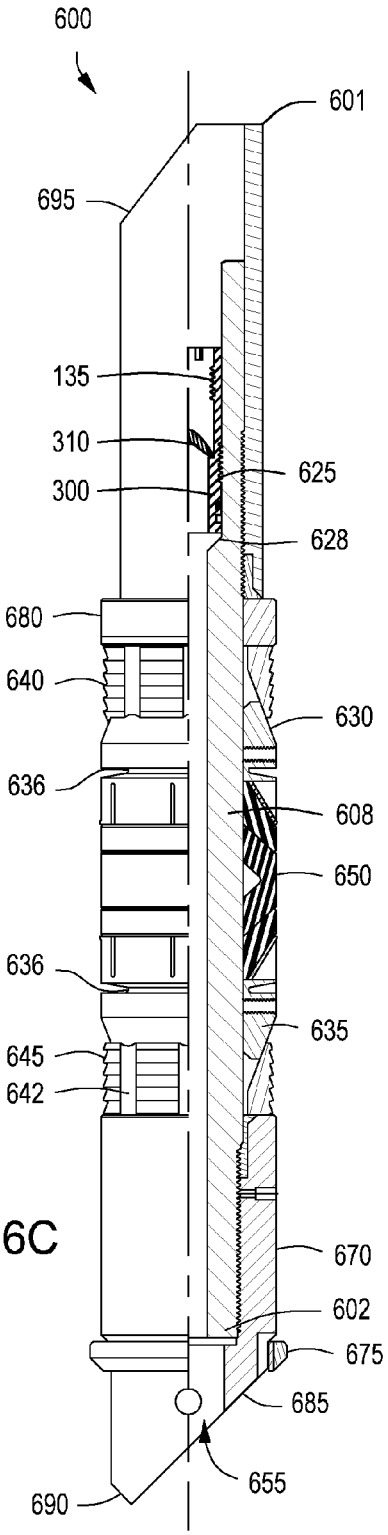
FIG. 6C depicts a partial section view of the plug configured with the insert shown in FIG. 3, according to one or more embodiments described.

FIG. 6C depicts a partial section view of the plug 600 configured with the insert 300, according to one or more embodiments. The outer threads 105 of the insert 300 can be engaged with the threads 625 formed in the body 608 of the plug 600. The insert 300 can include the flapper member 310. The flapper member 310 can be flat or substantially flat. Alternatively, the flapper member 310 can have an arcuate shape with a convex upper surface and a concave lower surface. As used herein the term "arcuate" refers to any body, member, or thing having a cross-section resembling an arc. For example, a flat, elliptical member with both ends along the major axis turned downwards by a generally equivalent amount can form an arcuate member.

A spring or other tension member (not shown) can be disposed about the one or more pivot pins 330 to urge the flapper member 310 from a run-in ("first" or "open") position wherein the flapper member 310 does not obstruct the bore 655 through the plug 600, to an operating ("second" or "closed") position (not shown), where the flapper member 310 assumes a position proximate to the shoulder or valve seat 325 transverse to the bore 655 of the plug 600. At least a portion of the spring can be disposed upon or across the upper surface of the flapper member 310 providing greater contact between the spring and the flapper member 310 offering greater leverage for the spring to displace the flapper member 310 from the run-in position to the operating position. In the run-in position, fluid can flow through the bore 655 of the plug 600 in both directions. In the operating position, fluid can only flow through the bore 655 of the plug 600 in one direction, e.g., upward or toward the first end 601 of the plug 600. Additional details of a suitable flapper assembly can be found in U.S. Pat. No. 7,708,066, which is incorporated by reference herein in its entirety.

Figure 6D:
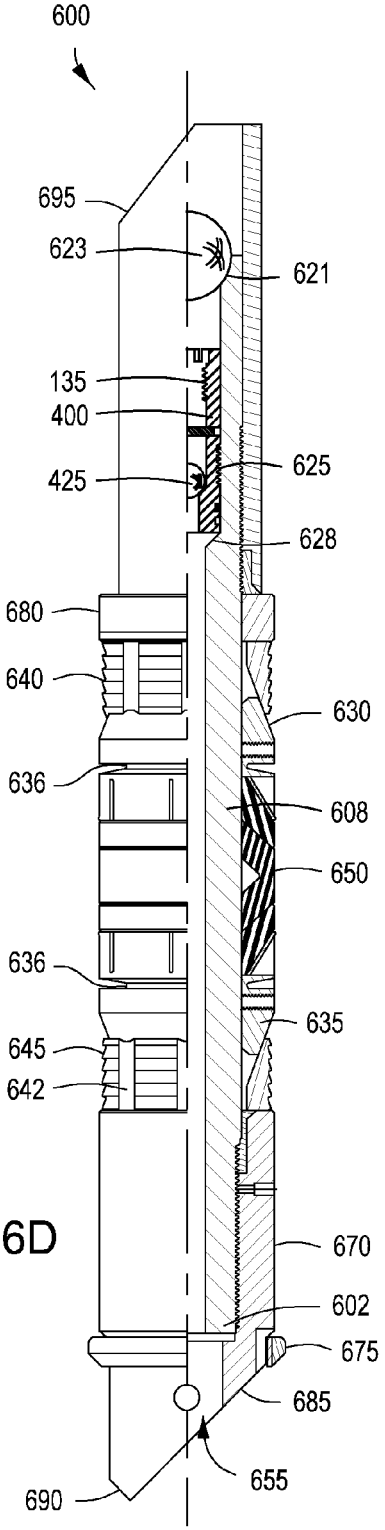
FIG. 6D depicts a partial section view of the plug configured with the insert shown in FIG. 4, according to one or more embodiments described.

FIG. 6D depicts a partial section view of the plug 600 configured with the insert 400, according to one or more embodiments. The outer threads 105 of the insert 400 can be engaged with the threads 625 formed in the body 608 of the plug 600. A ball 643 can be disposed within the bore 655 of the plug 600 below the insert 400. The lower shoulder 440 of the insert 400 (see FIG. 4B) can act as a seat for the ball 643. When the ball 643 is disposed against the lower shoulder 440, the ball 643 can constrain, restrict, and/or prevent fluid from flowing in a first or "upward" direction through the bore 655 of the plug 600 while allowing fluid to flow in a second or "downward" direction through the bore 655 of the plug 600. A retaining pin or washer can be installed in the lower end 602 of the plug 600 to prevent the ball 643 from exiting the bore 655. As such, the ball 643 can move within the bore 655 between the lower shoulder 440 of the insert 400 and the retaining pin or washer.

Additionally, a second ball 425 can be disposed within the bore 655 of the plug 600. The upper shoulder 420 of the insert 400 (see FIG. 4B) can act as a seat for the ball 425. When the ball 425 is disposed against the upper shoulder 420, the ball 425 can constrain, restrict, and/or prevent fluid from flowing in the second or "downward" direction through the bore 655 of the plug 600 while allowing fluid to flow in the first or "upward" direction through the bore 655 of the plug 600.

The body 608 of the plug 600 can also include a ball seat 621 formed therein. The ball seat 621 can be disposed above the shoulder 628, the conical member 630, the slip 640, the malleable element 650, and/or the annular member 680. The ball seat 621 can also be located above one or more shear grooves (not shown) and/or the threads 603. A third ball 623 can be disposed within the bore 655 of the plug 600. When the ball 623 is disposed against the ball seat 621, the ball 623 can constrain, restrict, and/or prevent fluid from flowing in the second or "downward" direction through the bore 655 of the plug 600 while allowing fluid to flow in the first or "upward" direction through the bore 655 of the plug 600.

Figure 6E:
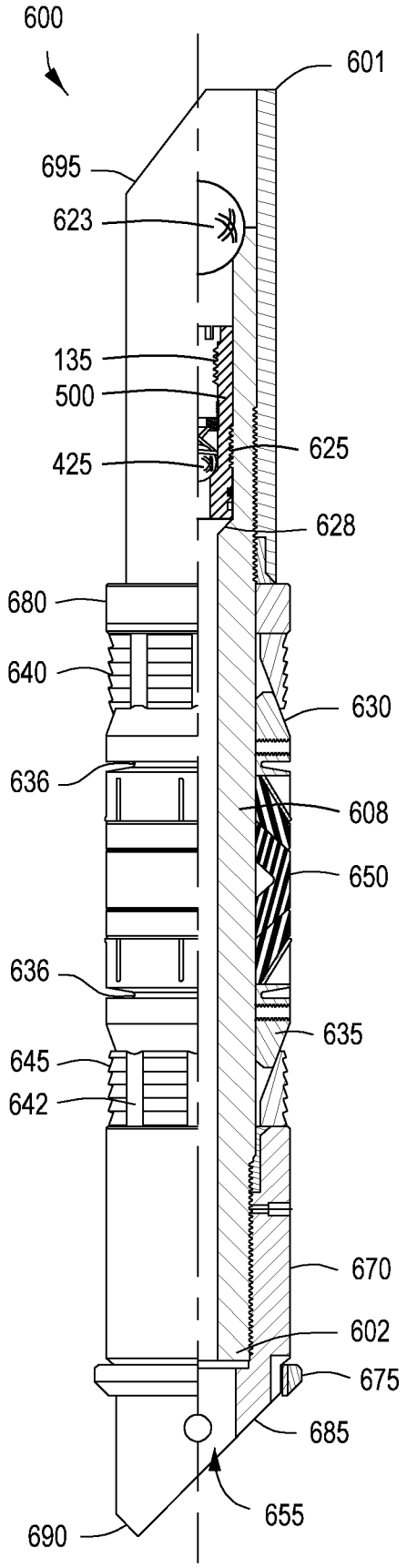
FIG. 6E depicts a partial section view of the plug configured with the insert shown in FIG. 5, according to one or more embodiments described.

FIG. 6E depicts a partial section view of the plug 600 configured with the insert 500, according to one or more embodiments. The outer threads 105 of the insert 500 can be engaged with the threads 625 formed in the body 608 of the plug 600. The ball 425 can be disposed within the bore 655 of the plug 600. The upper shoulder 420 of the insert 500 (see FIG. 5) can act as a seat for the ball 425. When the ball 425 is disposed against the upper shoulder 420, the ball 425 can constrain, restrict, and/or prevent fluid from flowing in the second or "downward" direction through the bore 655 of the plug 600 while allowing fluid to flow in the first or "upward" direction through the bore 655 of the plug 600.

The flapper member 310 (see FIGS. 3 and 6C) and the balls 425, 623, 643 (see FIGS. 4A, 5, 6D, and 6E) can be fabricated from one or more decomposable materials. Suitable decomposable materials can decompose, degrade, degenerate, or otherwise fall apart at certain wellbore conditions or environments, such as predetermined temperature, pressure, pH, and/or any combinations thereof. As such, fluid communication through the plug 600 can be prevented for a predetermined period of time, e.g., until and/or if the decomposable material(s) degrade sufficiently allowing fluid flow therethrough. The predetermined period of time can be sufficient to pressure test one or more hydrocarbon-bearing zones within the wellbore. In one or more embodiments, the predetermined period of time can be sufficient to workover the associated well. The predetermined period of time can range from minutes to days. For example, the degradable rate of the material can range from about 5 minutes, 40 minutes, or 4 hours to about 12 hours, 24 hours or 48 hours. Extended periods of time are also contemplated.

The pressures at which the flapper member 310 and/or the balls 425, 623, 643 decompose can range from about 100 psig to about 15,000 psig. For example, the pressure can range from a low of about 100 psig, 1,000 psig, or 5,000 psig to a high about 7,500 psig, 10,000 psig, or about 15,000 psig. The temperatures at which the flapper member 310 and/or the balls 425, 623, 643 decompose can range from about 100° F. to about 750° F. For example, the temperature can range from a low of about 100° F., 150° F., or 200° F. to a high of about 350° F., 500° F., or 750° F.

The decomposable material can be soluble in any fluid, such as water, polar solvents, non-polar solvents, acids, bases, mixtures thereof, or any combination thereof. The solvents can be time-dependent solvents. A time-dependent solvent can be selected based on its rate of degradation. For example, suitable solvents can include one or more solvents capable of degrading the soluble components in about 30 minutes, 1 hour, or 4 hours, to about 12 hours, 24 hours, or 48 hours. Extended periods of time are also contemplated. The pHs at which the flapper member 310 and/or the balls 425, 623, 643 decompose can range from about 1 to about 14. For example, the pH can range from a low of about 1, 3, or 5 to a high about 9, 11, or about 14.

Figure 7:
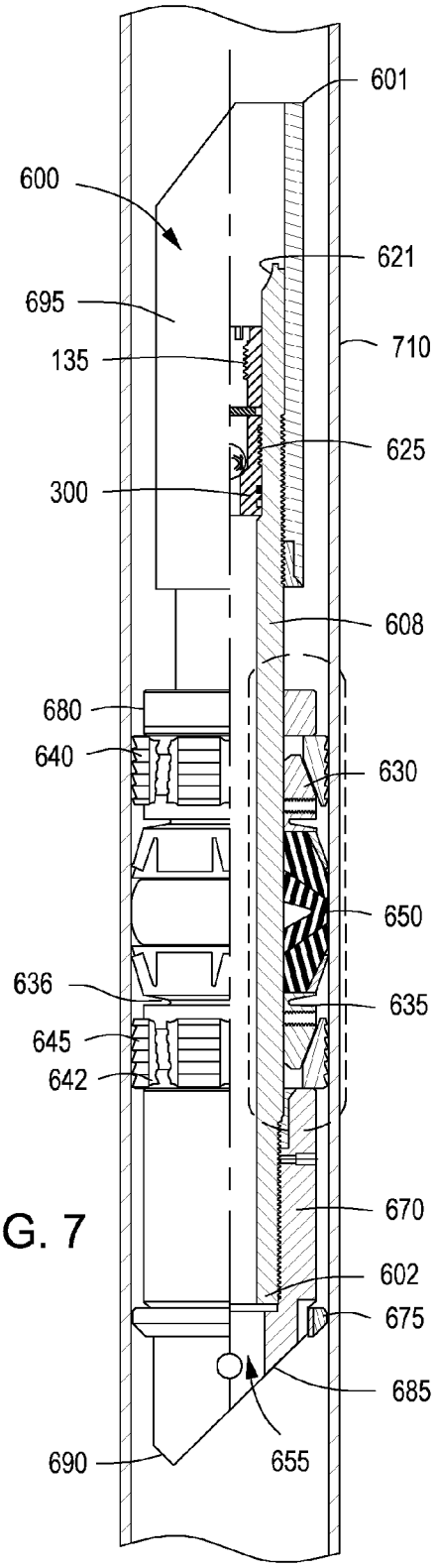
FIG. 7 depicts a partial section view of the plug of FIG. 6B located in an expanded or actuated position within a casing or wellbore, according to one or more embodiments described.
Figure 8:
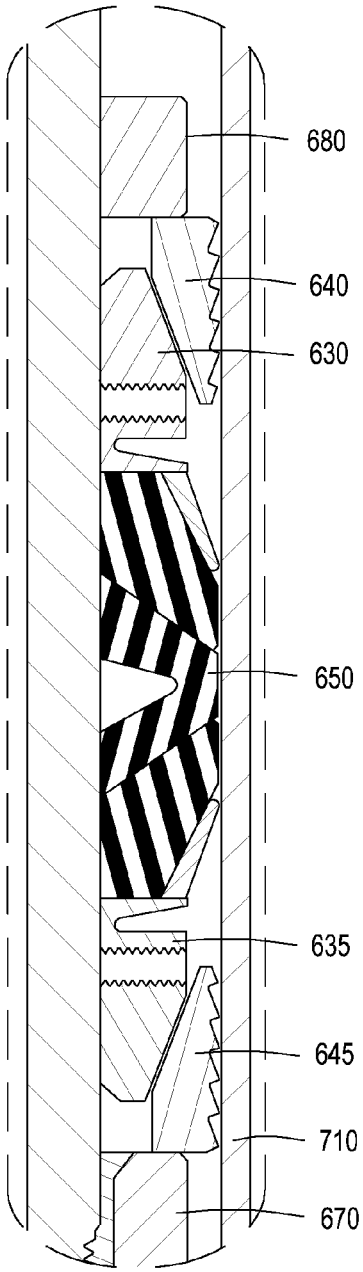
FIG. 8 depicts a partial section view of the expanded plug depicted in FIG. 7, according to one or more embodiments described.

FIG. 7 depicts a partial section view of the plug 600 located in an expanded or actuated position within a casing or wellbore 710, and FIG. 8 depicts an illustrative partial section view of the expanded plug 600 depicted in FIG. 7, according to one or more embodiments. The plug 600 can be installed in a vertical, horizontal, or deviated wellbore 710 using any suitable setting tool adapted to engage the plug 600. One example of such a suitable setting tool or assembly includes a gas operated outer cylinder powered by combustion products and an adapter rod. The outer cylinder of the setting tool abuts an outer, upper end of the plug 600, such as against the annular member 680. The outer cylinder can also abut directly against the upper slip 640, for example, in embodiments of the plug 600 where the annular member 680 is omitted, or where the outer cylinder fits over or otherwise avoids bearing on the annular member 680. Suitable setting assemblies that are commercially-available include the Owen Oil Tools wireline pressure setting assembly or a Model 10, 20 E-4, or E-5 Setting Tool available from Baker Oil Tools, for example.

In operation, the adapted rod of the setting tool can be threadably engaged with the threads 603 of the body 608. The adapter rod can exert an axial force on the body 608 in an upward direction. This upward force can be matched by the outer cylinder (not shown) of the setting tool exerting an equal and opposite force against the outer, upper end of the plug 600 in a downward direction. For example, in the embodiments illustrated in FIGS. 6A-6E, the outer cylinder of the setting assembly exerts a downward force on the annular member 680. The opposing forces cause the slips 640, 645 and the malleable elements 650 to slide downward along the body 608 of the plug 600. The translated force fractures the recessed groove(s) 642 of the slips 640, 645, allowing the slips 640, 645 to expand outward and engage the inner surface of the casing or wellbore 710, while at the same time compresses the malleable elements 650 to create a seal between the plug 600 and the inner surface of the casing or wellbore 710.

After actuation or installation of the plug 600, the setting tool can be released from the plug 600 by continuing to apply the opposing axial and/or radial forces on the body 608 via the threads 603. The opposing forces applied by the outer cylinder and the adapter rod can result in a compressive load on the body 608, which is borne as internal stress once the plug 600 is actuated and secured within the casing or wellbore 710. The force or stress can be focused on the threads 603 of the body 608, which will eventually shear, break, or otherwise deform at a predetermined amount, releasing the adapter rod therefrom. The predetermined force sufficient to deform the threads 603 to release the adapter rod of the setting tool can be less than a force sufficient to break the body 608 of the plug 600.

In another embodiment, the outer threads 105 of the insert 100, 300, 400, 500 can be threadably engaged with the threads 625 of the body 608, and the adapter rod can be threadably engaged with the shearable threads 135 of the insert 100, 300, 400, 500. The adapter rod can exert an axial force on the body 608 (via the insert 100, 300, 400, 500) in an upward direction. This upward force can be matched by the outer cylinder (not shown) of the setting tool exerting an equal and opposite force against the outer, upper end of the plug 600 in a downward direction. For example, in the embodiments illustrated in FIGS. 6A-6E, the outer cylinder of the setting assembly exerts a downward force on the annular member 680. The opposing forces cause the slips 640, 645 and the malleable elements 650 to slide downward along the body 608 of the plug 600. The translated force fractures the recessed groove(s) 642 of the slips 640, 645, allowing the slips 640, 645 to expand outward and engage the inner surface of the casing or wellbore 710, while at the same time compresses the malleable elements 650 to create a seal between the plug 600 and the inner surface of the casing or wellbore 710.

After actuation or installation of the plug 600, the setting tool can be released from the plug 600 by continuing to apply the opposing axial and/or radial forces on the insert 100, 300, 400, 500 via the adapter rod of the setting tool. The force results in a compressive load on the insert 100, 300, 400, 500. The force or stress can be focused on the shearable threads 135 of the insert 100, 300, 400, 500, which can eventually shear, break, or otherwise deform at a predetermined amount, releasing the adapter rod therefrom. The predetermined force sufficient to deform the shearable threads 135 to release the adapter rod of the setting tool can be less than a force sufficient to break the outer threads 105 of the insert 100, 300, 400, 500, the insert 100, 300, 400, 500 itself, the threads 625 on the body 608 of the plug 600, and/or the body 608 of the plug 600 itself. Once actuated and released from the setting tool, the plug 600 is left in the wellbore to serve its purpose.

To remove the plug 600 from the wellbore 710, the plug 600 can be drilled-out, milled, or otherwise compromised. As it is common to have two or more plugs 600 located in a single wellbore 710 to isolate multiple zones therein, during removal of one or more plugs 600 from the wellbore 710 some remaining portion of a first, upper plug 600 can release from the wall of the wellbore at some point during the drill-out. Thus, when the remaining portion of the first, upper plug 600 falls and engages an upper end of a second, lower plug 600, the anti-rotation features 670 of the remaining portions of the plugs 600, can engage and prevent, or at least substantially reduce, relative rotation therebetween.

Figure 10:
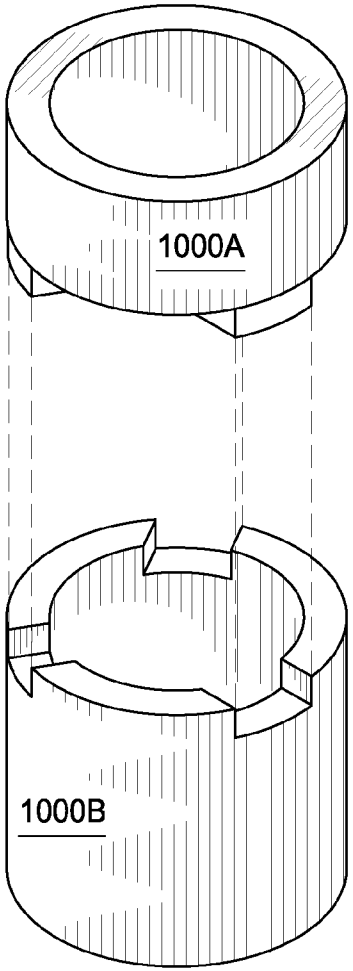
FIG. 10 depicts an illustrative, dog clutch anti-rotation feature, allowing a first plug and a second plug to interact and/or engage in series, according to one or more embodiments described.
Figure 9:
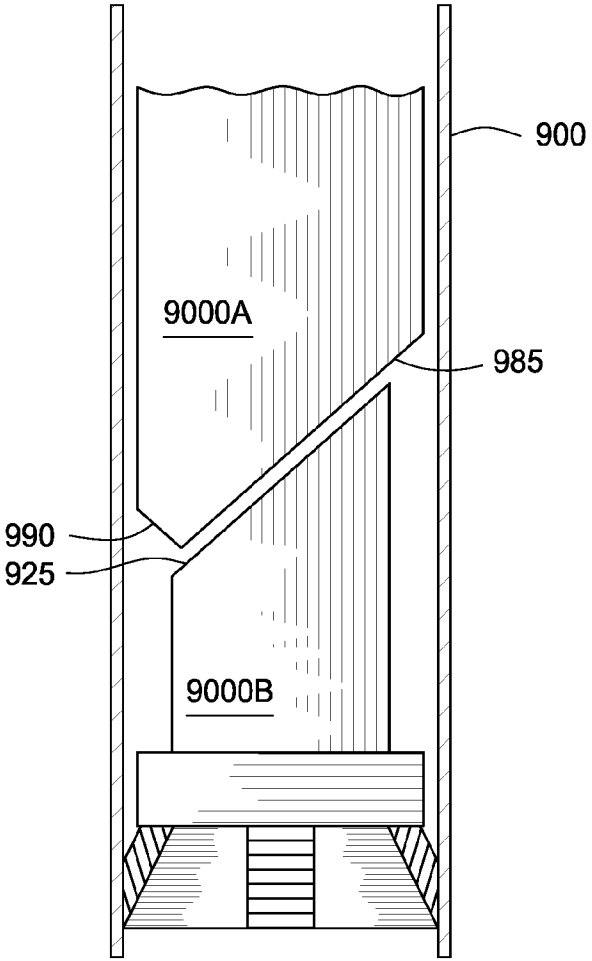
FIG. 9 depicts an illustrative, complementary set of angled surfaces that function as anti-rotation features adapted to interact and/or engage between a first plug and a second plug in series, according to one or more embodiments described.
Figure 12:
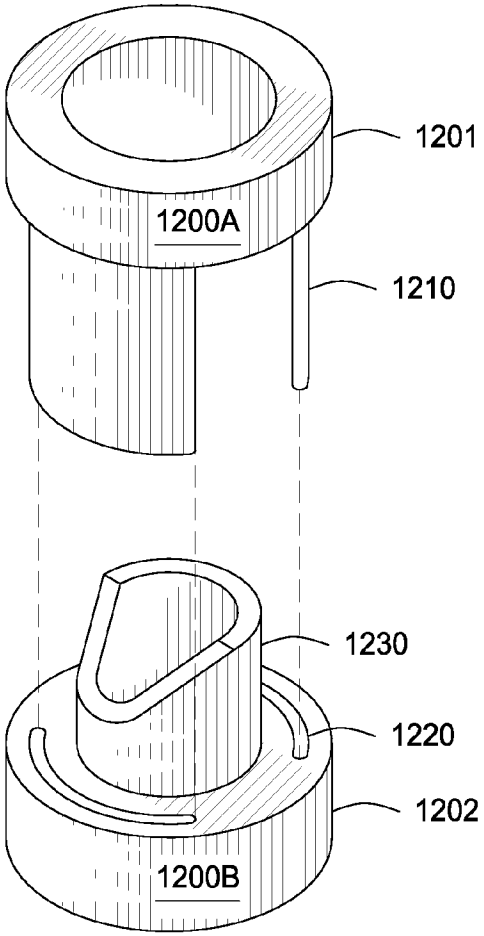
FIG. 12 depicts another illustrative, complementary set of flats and slots that serve as anti-rotation features to interact and/or engage between a first plug and a second plug in series, according to one or more embodiments described.
Figure 11:
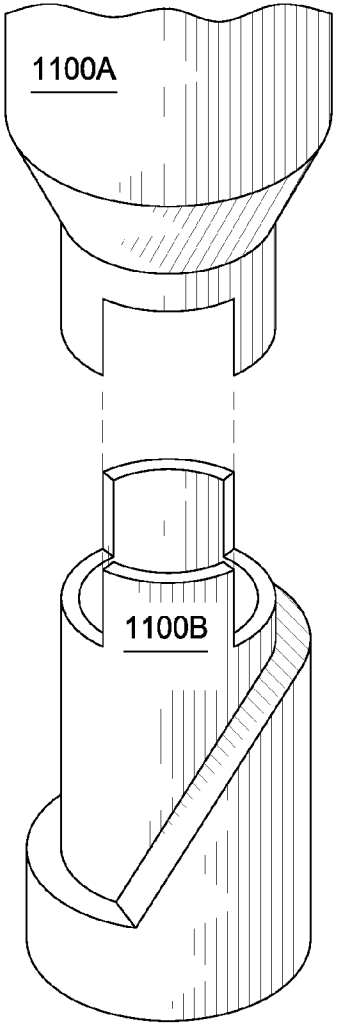
FIG. 11 depicts an illustrative, complementary set of flats and slots that serve as anti-rotation features to interact and/or engage between a first plug and a second plug in series, according to one or more embodiments described.

FIGS. 9-12 depict schematic views of illustrative anti-rotation features 670 that can be used with the plugs 600 to prevent or reduce rotation during drill-out. These features are not intended to be exhaustive, but merely illustrative, as there are many other configurations that are equally effective to accomplish the same results. Each end of the plug 600 can be the same or different. For example, FIG. 9 depicts angled surfaces or half-mule anti-rotation features; FIG. 10 depicts dog clutch type anti-rotation features; and FIGS. 11 and 12 depict two types of flats and slotted noses or anti-rotation features.

Referring to FIG. 9, a lower end of the upper plug 900A and an upper end of the lower plug 900B are shown within the casing 710 where the angled surfaces 985, 990 interact with, interface with, interconnect, interlock, link with, join, jam with or within, wedge between, or otherwise communicate with a complementary angled surface 925 and/or at least a surface of the wellbore or casing 900. The interaction between the lower end of the upper plug 900A and the upper end of the lower plug 900E and/or the casing 900 can counteract a torque placed on the lower end of the upper plug 900A, and prevent or greatly reduce rotation therebetween. For example, the lower end of the upper plug 900A can be prevented from rotating within the wellbore or casing 900 by the interaction with upper end of the lower plug 900B, which is held securely within the casing 900.

Referring to FIG. 10, dog clutch surfaces of the upper plug 1000A can interact with, interface with, interconnect, interlock, link with, join, jam with or within, wedge between, or otherwise communicate with a complementary dog clutch surface of the lower plug 1000B and/or at least a surface of the wellbore or casing 900. The interaction between the lower end of the upper plug 1000A and the upper end of the lower plug 1000B and/or the casing 900 can counteract a torque placed on the lower end of the upper plug 1000A, and prevent or greatly reduce rotation therebetween. For example, the lower end of the upper plug 1000A can be prevented from rotating within the wellbore or casing 900 by the interaction with the upper end of the lower plug 1000B, which is held securely within the casing 900.

Referring to FIG. 11, the flats and slotted surfaces of the upper plug 1100A can interact with, interface with, interconnect, interlock, link with, join, jam with or within, wedge between, or otherwise communicate with a complementary flats and slotted surfaces of the lower plug 1100B and/or at least a surface of the wellbore or casing 900. The interaction between the lower end of the upper plug 1100A and the upper end of the lower plug 1100B and/or the casing 900 can counteract a torque placed on the lower end of the upper plug 1100A, and prevent or greatly reduce rotation therebetween. For example, the lower end of the upper plug 1100A can be prevented from rotating within the wellbore or casing 900 by the interaction with upper end of the lower plug 1100B, which is held securely within the casing 900. The protruding perpendicular surfaces of the lower end of the upper plug 1100A can mate in only one resulting configuration with the complementary perpendicular voids of the upper end of the lower plug 1100B. When the lower end of the upper plug 1100A and the upper end of the lower plug 1100B are mated, any further rotational force applied to the lower end of the upper plug 1100A can be resisted by the engagement of the lower plug 1100B with the wellbore or casing 900, translated through the mated surfaces of the anti-rotation feature 670, allowing the lower end of the upper plug 1100A to be more easily drilled-out of the wellbore.

An alternative configuration of flats and slotted surfaces is depicted in FIG. 12. The protruding cylindrical or semi-cylindrical surfaces 1210 perpendicular to the base 1201 of the lower end of the upper plug 1200A mate in only one resulting configuration with the complementary aperture(s) 1220 in the complementary base 1202 of the upper end of the lower plug 1200B. Protruding surfaces 1210 can have any geometry perpendicular to the base 1201, as long as the complementary aperture(s) 1220 match the geometry of the protruding surfaces 1201 so that the surfaces 1201 can be threaded into the aperture(s) 1220 with sufficient material remaining in the complementary base 1202 to resist rotational force that can be applied to the lower end of the upper plug 1200A, and thus translated to the complementary base 1202 by means of the protruding surfaces 1201 being inserted into the aperture(s) 1220 of the complementary base 1202. The anti-rotation feature 670 may have one or more protrusions or apertures 1230, as depicted in FIG. 12, to guide, interact with, interface with, interconnect, interlock, link with, join, jam with or within, wedge between, or otherwise communicate or transmit force between the lower end of the upper plug 1200A and the upper end of the lower plug 1200B. The protrusion or aperture 1230 can be of any geometry practical to further the purpose of transmitting force through the anti-rotation feature 670.

The orientation of the components or anti-rotation features 670 depicted in all figures is arbitrary. Because plugs 600 can be installed in horizontal, vertical, and deviated wellbores, either end of the plug 600 can have any anti-rotation feature 670 geometry, wherein a single plug 600 can have one end of the first geometry and one end of the second geometry. For example, the anti-rotation feature 670 depicted in FIG. 9 can include an alternative embodiment where the lower end of the upper plug 900A is manufactured with geometry resembling 900B and vice versa. Each end of each plug 600 can be or include angled surfaces, half-mule, mule shape, dog clutch, flat and slot, cleated, slotted, spiked, and/or other interdigitating designs. In the alternative to a plug 600 with complementary anti-rotation feature 670 geometry on each end of the plug 600, a single plug 600 can include two ends of differently-shaped anti-rotation features, such as the upper end may include a half-mule anti-rotation feature 670, and the lower end of the same plug 600 may include a dog clutch type anti-rotation feature 670. Further, two plugs 600 in series may each comprise only one type anti-rotation feature 670 each, however the interface between the two plugs 600 may result in two different anti-rotation feature 670 geometries that can interface with, interconnect, interlock, link with, join, jam with or within, wedge between, or otherwise communicate or transmit force between the lower end of the upper plug 600 with the first geometry and the upper end of the lower plug 600 with the second geometry.

Any of the aforementioned components of the plug 600, including the body, rings, cones, elements, shoe, etc., can be formed or made from any one or more metallic materials (such as aluminum, steel, stainless steel, brass, copper, nickel, cast iron, galvanized or non-galvanized metals, etc.), fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66

(N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

However, as many components as possible are made from one or more composite materials. Suitable composite materials can be or include polymeric composite materials that are reinforced by one or more fibers such as glass, carbon, or aramid, for example. The individual fibers can be layered parallel to each other, and wound layer upon layer. Each individual layer can be wound at an angle of from about 20 degrees to about 160 degrees with respect to a common longitudinal axis, to provide additional strength and stiffness to the composite material in high temperature and/or pressure downhole conditions. The particular winding phase can depend, at least in part, on the required strength and/or rigidity of the overall composite material.

The polymeric component of the composite can be an epoxy blend. The polymer component can also be or include polyurethanes and/or phenolics, for example. In one aspect, the polymeric composite can be a blend of two or more epoxy resins. For example, the polymeric composite can be a blend of a first epoxy resin of bisphenol A and epichlorohydrin and a second cycoaliphatic epoxy resin. Preferably, the cycloaphatic epoxy resin is ARALDITE® liquid epoxy resin, commercially available from Ciga-Geigy Corporation of Brewster, N.Y. A 50:50 blend by weight of the two resins has been found to provide the suitable stability and strength for use in high temperature and/or pressure applications. The 50:50 epoxy blend can also provide suitable resistance in both high and low pH environments.

The fibers can be wet wound. A prepreg roving can also be used to form a matrix. The fibers can also be wound with and/or around, spun with and/or around, molded with and/or around, or hand laid with and/or around a metallic material or two or more metallic materials to create an epoxy impregnated metal or a metal impregnated epoxy.

A post cure process can be used to achieve greater strength of the material. A suitable post cure process can be a two stage cure having a gel period and a cross-linking period using an anhydride hardener, as is commonly know in the art. Heat can be added during the curing process to provide the appropriate reaction energy that drives the cross-linking of the matrix to completion. The composite may also be exposed to ultraviolet light or a high-intensity electron beam to provide the reaction energy to cure the composite material.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A plug for isolating a wellbore, comprising:
a body having a first end and a second end;
at least one malleable element about the body;
at least one slip about the body;
at least one conical member about the body; and
an insert disposed entirely within the body and screwed into an inner surface of the body below the first end of the body and above the at least one malleable element, wherein the insert has a bore formed at least partially therethrough and comprises:
one or more threads on an outer surface thereof and adapted to threadably engage the inner surface of the body proximate the first end of the body; and
one or more shearable threads on an inner surface of the bore, wherein the one or more shearable threads are adapted to threadably engage a setting tool that enters the body through the first end of the plug and to deform to release the setting tool when exposed to a predetermined force that is less than a force required to deform the one or more threads on the outer surface of the insert.

2. The plug of claim 1, wherein the inner surface of the insert comprises a first diameter that transitions to a second diameter to form a shoulder within the bore.

3. The plug of claim 2, further comprising one or more impediments within the bore and adapted to contact the shoulder to prevent a flow of fluid through the bore in at least one direction.

4. The plug of claim 3, wherein the impediment is decomposable at a predetermined temperature, pressure, pH, or a combination thereof.

5. The plug of claim 3, wherein the impediment is a ball.

6. The plug of claim 5, further comprising a pin coupled to the insert and adapted to restrict movement of the ball within the bore.

7. The plug of claim 5, further comprising:
a ball stop coupled to the insert; and
a tension member coupled to the ball stop and adapted to urge the ball to seal against the shoulder.

8. The plug of claim 1, further comprising a flapper valve coupled to the inner surface of the insert and adapted to prevent a flow of fluid through the bore in at least one direction.

9. The plug of claim 1, wherein the insert is between the first end of the body and the at least one slip, and the at least one conical member.

10. The plug of claim 1, wherein the setting tool comprises an adapter rod, an outer cylinder, or both.

11. The plug of claim 1, wherein the body is made of a composite material.

12. The plug of claim 11, wherein the composite material comprises one or more wound layers.

13. The plug of claim 1, further comprising at least one anti-rotation feature disposed proximate the first and second ends of the body.

14. The plug of claim 1, further comprising at least one circumferential groove on the outer surface of the insert, wherein the at least one circumferential groove is adapted to retain an elastomeric seal.

15. The plug of claim 14, wherein the insert has an insert first end and an insert second end, wherein the threads on the outer surface of the insert and the shearable threads on the inner surface of the insert are between the insert first end and an end of the bore, and wherein the at least one circumferential groove is between the insert second end and the end of the bore.

16. The plug of claim 1, wherein at least one of the threads on the outer surface of the insert is axially adjacent to at least one of the shearable threads on the inner surface of the insert with respect to a central longitudinal axis through the insert.

* * * * *